United States Patent [19]

Hope

[11] Patent Number: 4,675,674

[45] Date of Patent: Jun. 23, 1987

[54] ARRANGEMENT FOR THE DISTRIBUTION AND/OR EXTRACTION OF SIGNALS

[76] Inventor: Bjorn R. Hope, Kampevn. 20, N-1350 Lommedalen, Norway

[21] Appl. No.: 456,009

[22] PCT Filed: Apr. 15, 1982

[86] PCT No.: PCT/NO82/00023

§ 371 Date: Dec. 15, 1982

§ 102(e) Date: Dec. 15, 1982

[87] PCT Pub. No.: WO82/03715

PCT Pub. Date: Oct. 28, 1982

[30] Foreign Application Priority Data

Apr. 15, 1981 [NO] Norway ..... 811318

[51] Int. Cl.[4] ..... G08C 19/04; G08C 15/08

[52] U.S. Cl. ..... 340/870.13; 340/870.11

[58] Field of Search ..... 340/825.36, 825.57, 340/825.65, 825.66, 825.67, 870.06, 870.13, 870.14, 870.24, 518, 820.11

[56] References Cited

U.S. PATENT DOCUMENTS

| | | | |
|---|---|---|---|
| 3,257,651 | 6/1966 | Feisel . | |
| 3,510,841 | 5/1970 | Lejon | 340/825.57 |
| 3,541,536 | 11/1970 | Starkey | 340/870.06 |
| 3,585,596 | 6/1971 | Rosenblatt | 340/825.65 |
| 4,100,542 | 7/1978 | Gallant | 340/870.13 |
| 4,162,489 | 7/1979 | Thilo . | |
| 4,194,180 | 3/1980 | Noren | 340/870.13 |
| 4,290,055 | 9/1981 | Furney . | |
| 4,413,259 | 11/1983 | Lutz | 340/825.65 |
| 4,509,170 | 4/1985 | Hollinger | 340/870.13 |

FOREIGN PATENT DOCUMENTS 964376 8/1950 France .

*Primary Examiner*—John W. Caldwell, Sr.
*Assistant Examiner*—Tyrone Queen
*Attorney, Agent, or Firm*—Kenyon & Kenyon

[57] ABSTRACT

An arrangement for a distribution and/or an extraction of signals to and from a number of connection points is connected to a common current circuit. The connection points may, in one embodiment, comprise a number of sensors operating as a time division multiplex channel system signaled by switching elements. The sensors represent separately sensed inputs on the common current circuit by output current pulses of short duration. A switching sequence for the switching elements is, in particular, a make before break sequence making it possible to distribute signals of more than one switching element to the same connection points, and, consequently, to construct a multi-dimensional structure of combinatorial circuits.

14 Claims, 17 Drawing Figures

ARRANGEMENT FOR THE DISTRIBUTION AND/OR EXTRACTION OF SIGNALS

The present invention relates to an arrangement for the distribution and/or extraction of signals, as stated in the introductory part of the following claims.

The field of application will mainly comprise interrogation and conversion of a large amount of sensor information in time division multiplex on a common line as well as transmission of information to points on the same line. It is possible by suitable combinations in the form of connection and tapping of the line signal paths to build a multidimensional structure of self generating combinatorial circuits.

In the art various kinds of time multiplex are known. German Specification No. 1 240 446 discloses such a device comprising several sequencially connected mono-stable multivibrators, the first one triggering the next etc. Resistive or capacitive sensors are among the components controlling the time during which the multivibrator is in a working state after a received trigger signal. After the multivibrator has fallen back into a resting position the subsequent multivibrator is triggered, etc.

The previously known systems involving use of multivibrators have the disadvantage that they are a load on the common signal and power supply line, every second transistor in the multivibrators always being conductive as well as the associated components of the circuit. With an increasing load on the line there will, thus, follow a reduction of the possibility of detection and transmission in the form of short current pulses generated on a common line. A considerable weakness is that erroneous triggering is easily released by transients on the line or through the sensors, which may give rise to completely uncontrolled firing of the separate multivibrators. A considerable disadvantage is, thus, that the sequence and the number of monostable multivibrators are not forcibly actuated from a point on the chain, preventing this form from being an integral part of a selfgenerating combinatorial circuit.

It is, thus, an object of the present invention to overcome said disadvantages, and the characterizing features of the invention will appear from the following claims as well as from the following description with reference to the drawing.

Figure 3A:
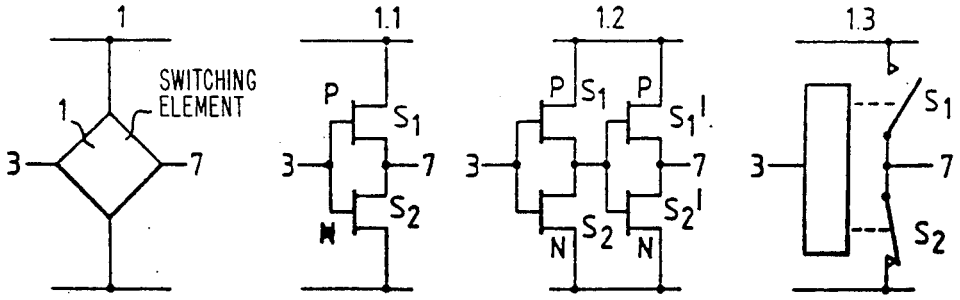
Figure 3B:
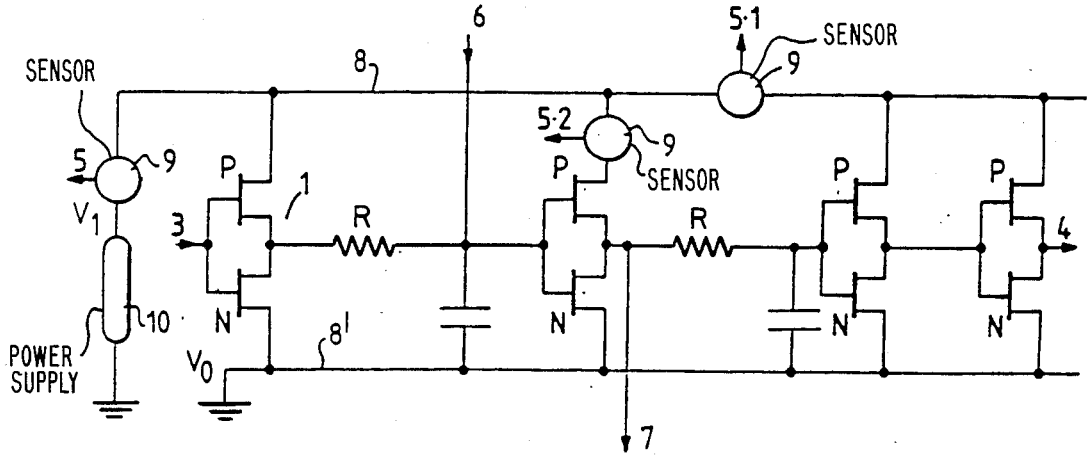
Figure 3C:
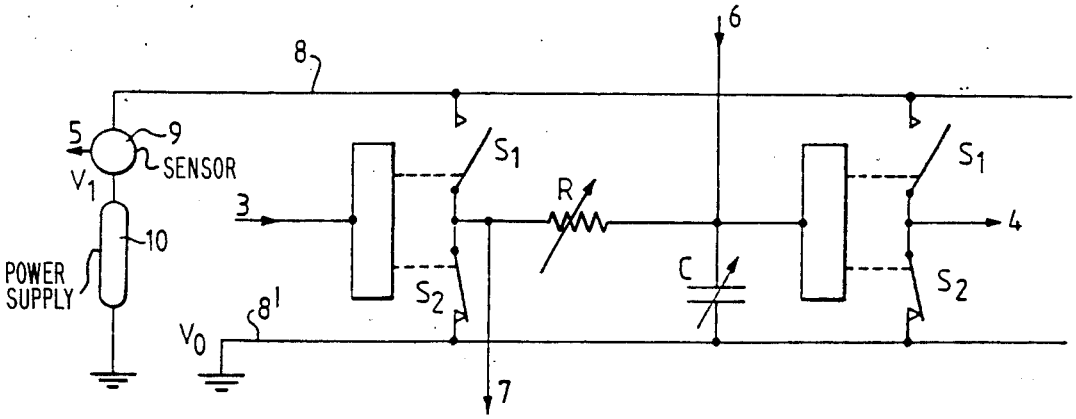

FIG. 3*a* shows examples of switching elements, and FIGS. 3*b*, and 3*c* show combinations of switching elements as well as delay circuits.

Figure 4:
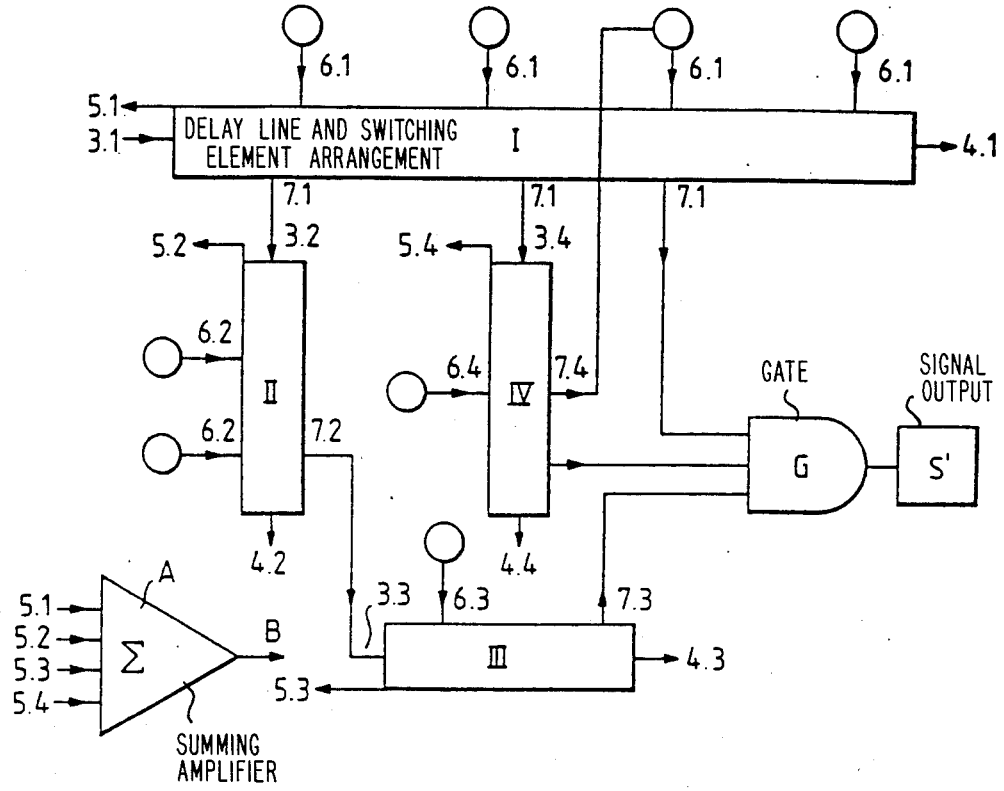

FIG. 4 is a block diagram of a non limiting embodiment of a delay line provided with several branches and illustrates combinations of the typical inputs and outputs.

Figure 5:
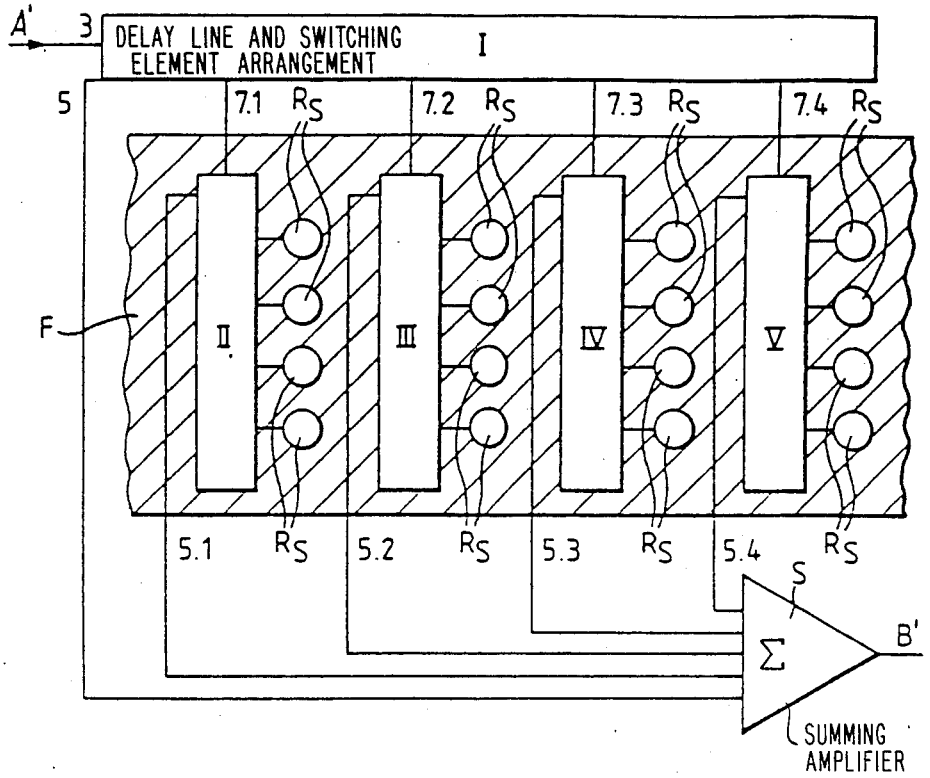
Figure 5:
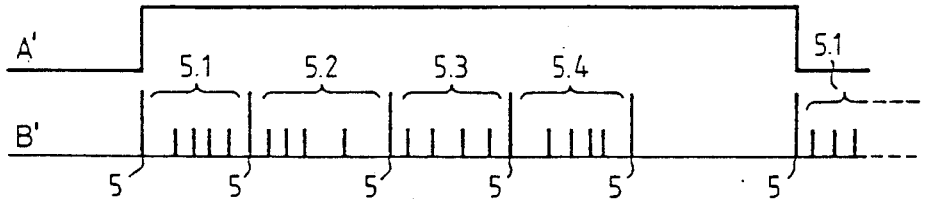

FIG. 5 illustrates an embodiment of delay lines used for measuring temperature gradients or mechanical tensions in a construction member, e.g. a beam or a plate.

Figure 6:
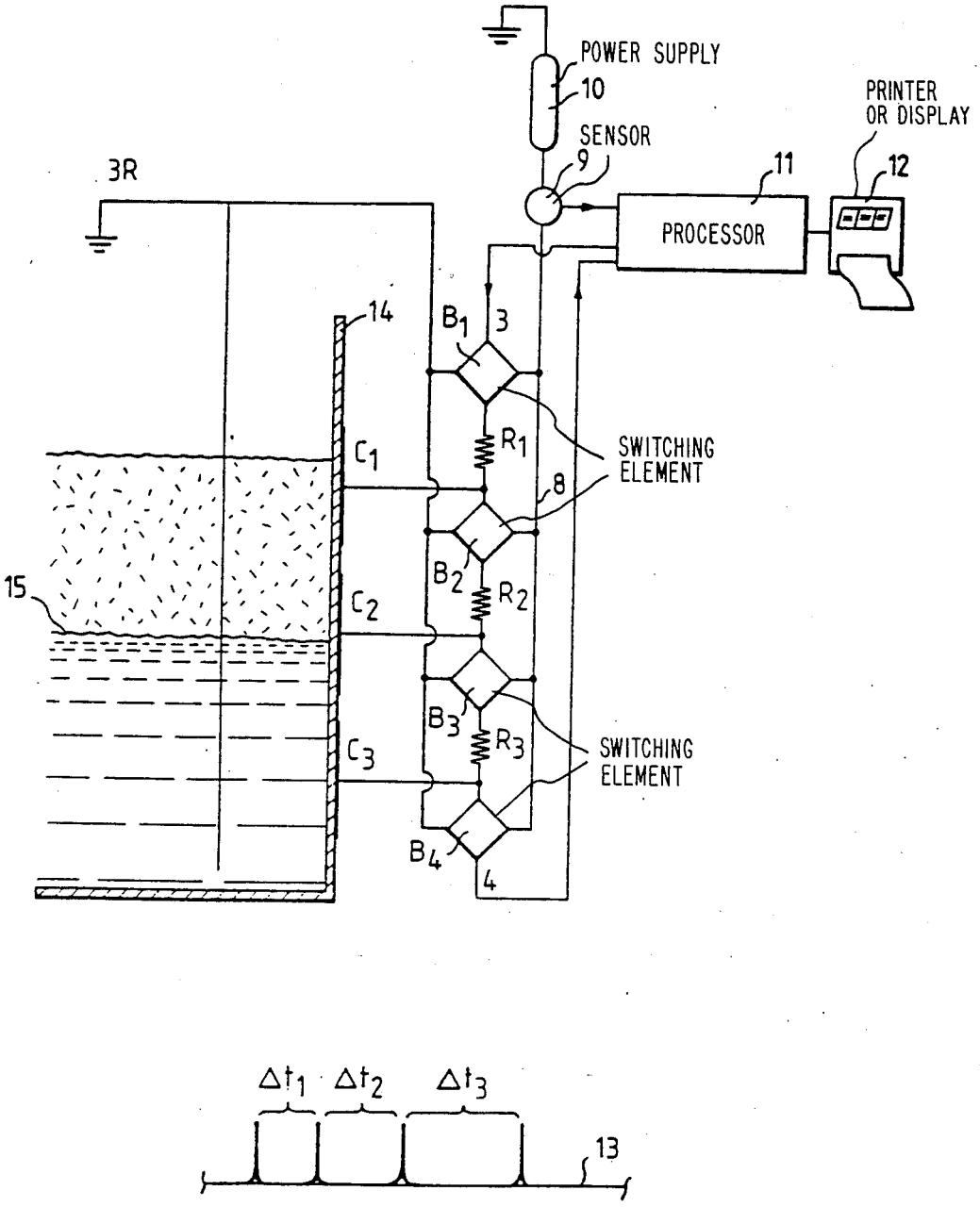

FIG. 6 illustrates a delay line used as a level indicator.

Figure 7:
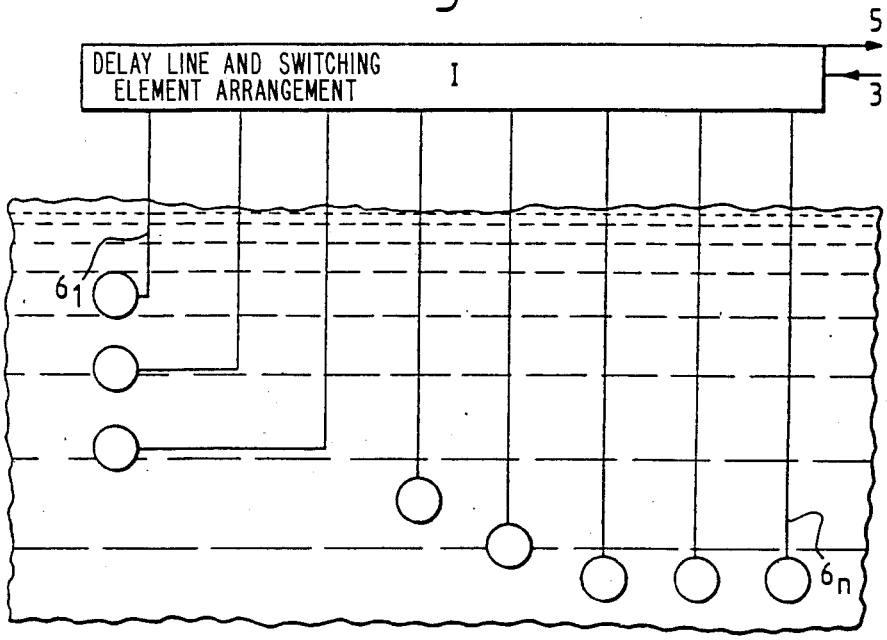

FIG. 7 illustrates a similar arrangement for recording temperature/temperature gradients in a medium.

Figure 8:
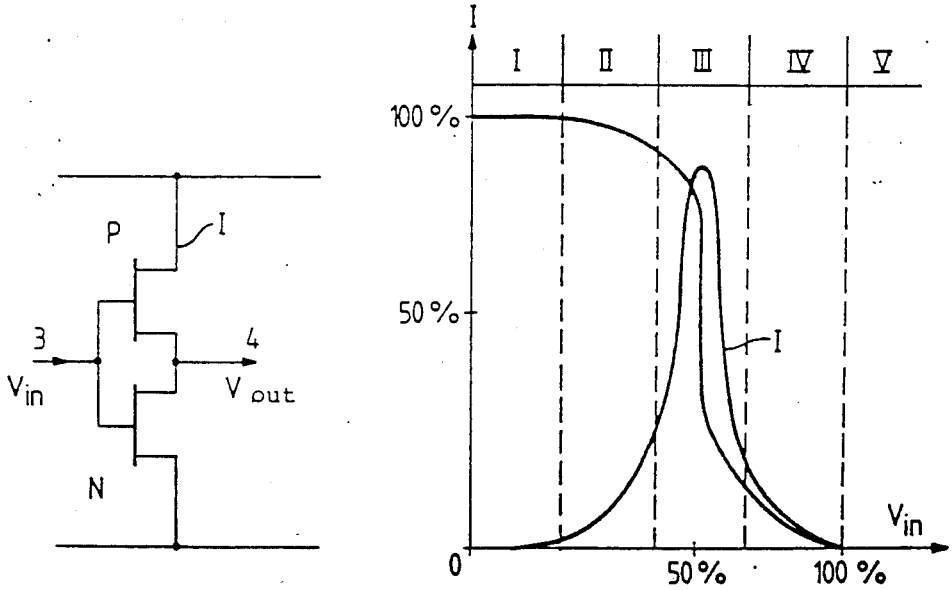

FIG. 8 is a diagram showing the current through the switching element as a function of the control signal on said switching element.

Figure 9:
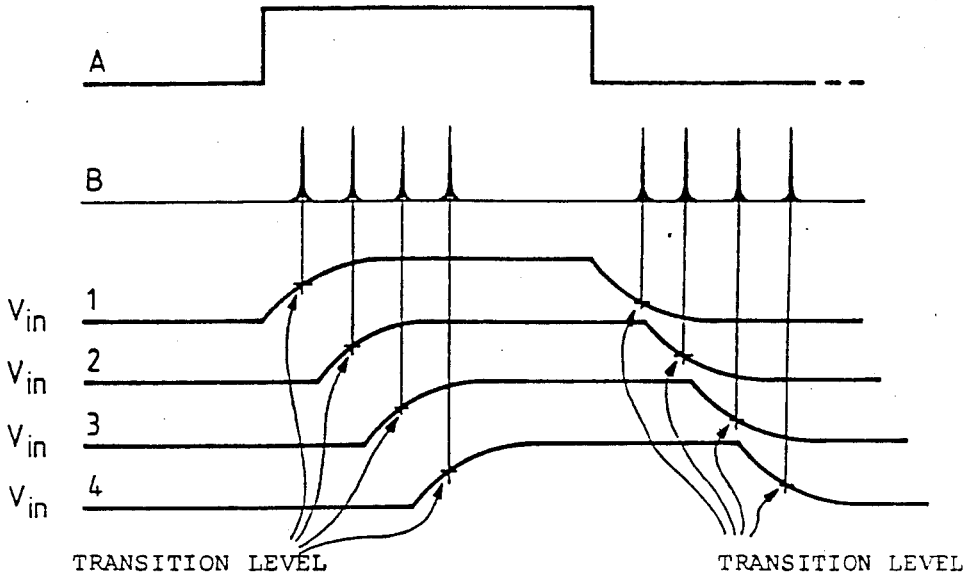

FIG. 9 is a typical illustration of the pulse sequence in connection with the various elements of a delay line.

Figure 1:
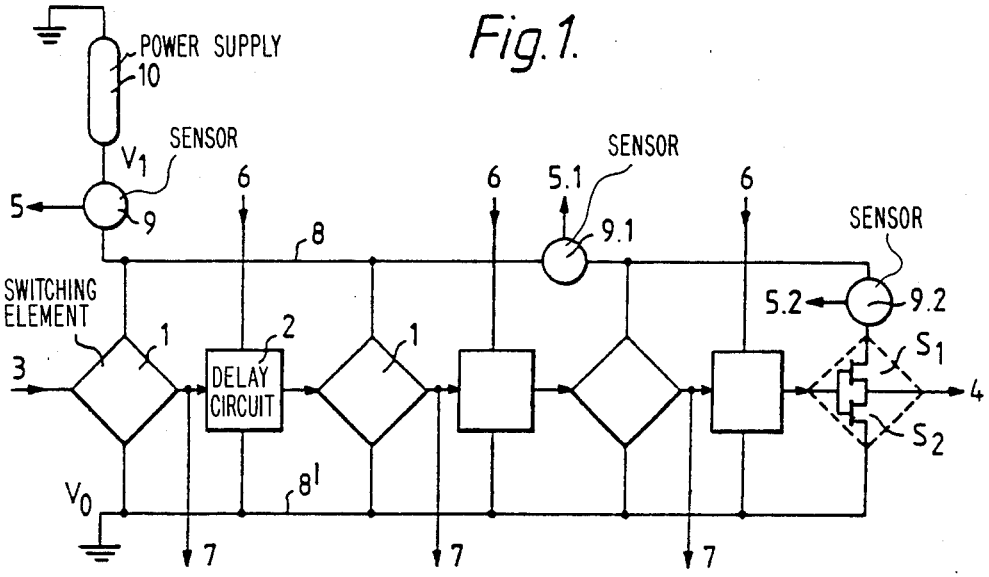
FIG. 1 is a schematic illustration of the arrangement according to the invention.
Figure 10:
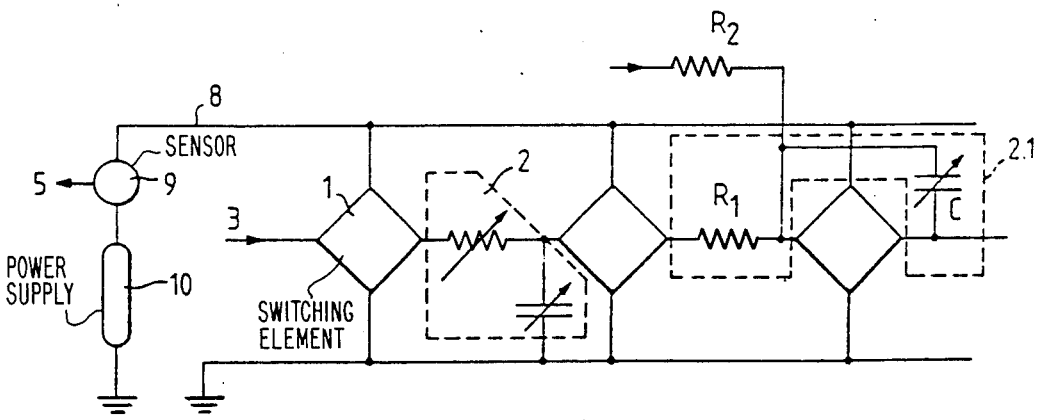

FIG. 10 shows a delay line substantially as shown in FIG. 1, but with passive elements illustrated.

Figure 11:
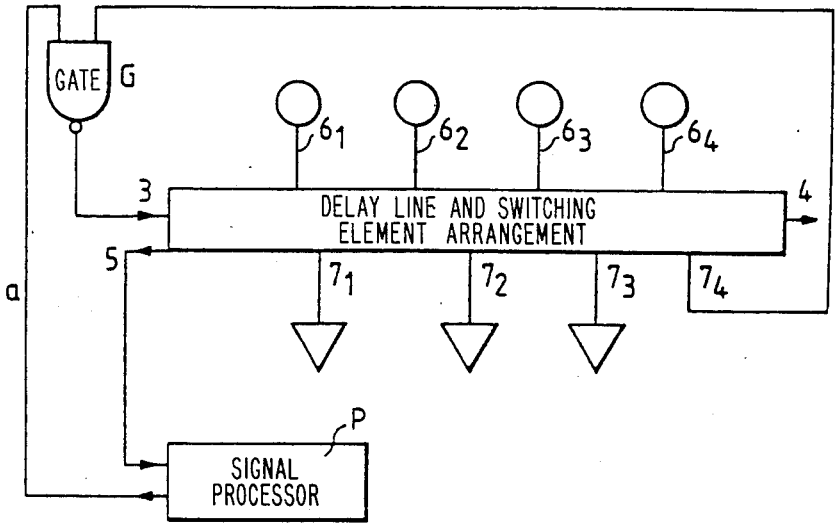
Figure 11:
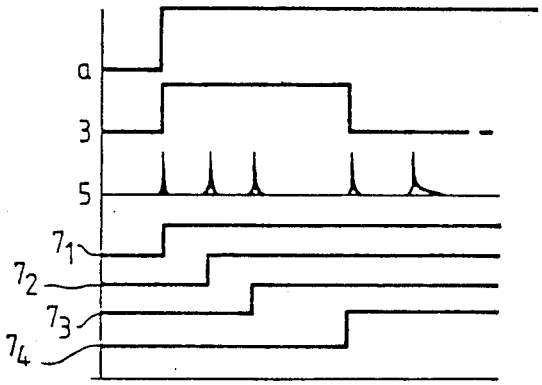

FIG. 11 shows a variant of a delay line having feedback.

FIGS. 12*a–d* illustrate some current sensing arrangements.

Similar reference numerals are used throughout the drawings to identify similar components.

In FIG. 1 switching elements 1 and delay circuits 2 are shown in a cascade connection. The common circuit is formed by wires 8 and 8' and a current source 10. In principle the cascade connections form a delay line with the characteristic inputs and outputs of different kinds. As shown in FIG. 1, these are mainly to be considered as static or dynamic. A control input 3 is provided for activation of the delay line at a change from a voltage level $V_o$ to $V_1$, or vice versa. In this manner it is determined which of the switches are open in a determined sequence and which of the switches are to close. During a short transition phase, when one switch $S_1$ or $S_2$ resp. closes before the other opens, the circuit 8, 8' will consequently be closed.

After a delay that is substantially determined by delay circuit 2, the same procedure is repeated and, thus, only one switching element at a time will be connected to the common circuit. Also, the number of switching elements in the sequence to be activated is controlled by the aid of the activating input 3.

Delay circuit 2 is provided with a direct input 6 affecting its time constant.

On an output 5 a dynamic output transmission is provided in short current pulse form from an output sensor 9 connected to the common transmission medium 8, as switching elements 1 close the circuit for short periods. The interval $\Delta t$ between pulses is directly proportional to the time constant in the intermediate delay circuit 2.

Output 4 represents the output on the last switching element in the delay line. Output 5 can record the current pulses from all switching elements connected to the common circuit by the aid of output sensor 9. This may also occur at outputs 5.1 and 5.2 in the form of partial recording by output sensors 9.1 and 9.2, which for instance may be located as shown in FIG. 1.

The time T consumed to effect a charge of state in all switching elements on the entire line equals the sum of the separate time delays $\Delta t$.

Each of the shown outputs 7 represents a static output from each of the switching elements 1. The level will change between $V_o$ and $V_1$ at every single change of state. An output 7 can be in phase or in antiphase with the input of the switching element, depending on the construction of said switching element.

Figure 2:
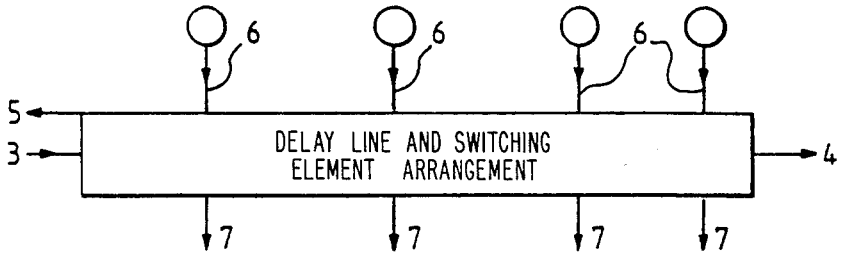
FIG. 2 is a block diagram of the arrangement according to FIG. 1.

In FIG. 2 the arrangement of FIG. 1 is shown in block form, where only inputs and outputs are indicated.

FIG. 3*a* shows some simple alternative switching elements, 1 being a symbol of the switching element with its connection with the common lines and input as well as output of the switching element. 1.1 illustrates a simple form of a switching element consisting of two inverting sequencially connected elements to achieve non-inverting as well as an improved switch characteristic. 1.3 illustrates a mainly mechanical switching element having the same main features as stated above.

In FIG. 3*b* the switching elements consist of semiconductors, e.g. complementary MOS transistors, the control of switches being effected by a change of state on the switching element input. When e.g. switch $S_1$ is a P-channel and $S_2$ a N-channel transistor, the first mentioned is open and the second one closed, depending on the common control input 3 of the switch being closer to $V_o$ than $V_1$, or vice versa. Only in the transfer phase as shown in FIGS. 8 and 9 both are conductive.

FIG. 3*c* shows an arrangement comprising mechanical switches, input 3 controlling the change of state of switches $S_1$ and $S_2$. The delay element consists mainly of a resistance R and a capacity C, which may be variable and may consist of various sensor elements to affect the time delay $\Delta t$. Input 6 permits the application of signals from outside to change the time constant from other circuit elements, sensors, feed backs from other delay lines, etc.

In FIG. 4 a block diagram illustrates a non-limiting embodiment of an arrangement of delay lines connected by their respective inputs for activating said delay lines 3.1–3.4 and 6.1–6.4 to control the delay circuits e.g. in the form of sensors elements. Outputs 5.1–5.4 represent the time intervals of the separate lines in form of current pulses.

Outputs 7.1 and 7.2 show branch lines that activate further lines after a certain number of time intervals. It is, furthermore, shown how the output on a branch line IV near output 7.4 affects the propagation time on line I. The degree of influence is affected by the time delay between changes of state on input 3.4 and output 7.4. Output 7.4 affects the delay element via input 6.1 on line I. A signal S' represents an instant at which e.g. outputs 7.1–7.4 have a certain state that is detected by a gate, indicated at G.

In the Figure a summing circuit A is shown having inputs 5.1–5.4, which may be connected to the outputs of the lines resp. The sum of time intervals as well as the mutual distribution in time is represented by output B' of the summing circuit. To make it easier to distinguish between the separate line signals in output B' of the summing circuit A, the separate inputs 5.1–5.4 may have different levels and/or polarities.

FIG. 5 shows a two-dimensional structure of said delay lines, where main line I upon an input A' activates branch lines II–V from their outputs 7.1–7.4 resp. On surface F sensors $R_s$ are provided and influence the delay $\Delta t$ on the delay circuits of branch delay lines II–V. Upon summation in a summing circuit S that is connected to outputs 5.0–5.4 by lines I–V a pulse pattern B' will be characteristic for the measuring parameters of the separate sensors. It is also possible to achieve further distinction between lines by difference of amplitudes.

FIG. 6 shows an embodiment of a one-dimensional structure representing a level measuring arrangement with capacitive sensors. The level or levels, if there is a question of layer formations of several media with differing dielectric constant, will be recordable only by change of capacitance between a ground reference 3R and the sensor elements $C_1$, $C_2$, and $C_3$. $R_1$, $R_2$, and $R_3$ are passive resistance elements, included as part of the delay circuit together with $C_1$, $C_2$, and $C_3$ resp., and either being in direct contact with the measured medium or insulated from said medium by an insulating material 14, depending on the nature of the measured medium 15.

Switching elements $B_1$–$B_4$ are connected with a common circuit 8 via current output sensor 9 and current source 10. The signal processing electronics 11 start interrogation at a change of state on line 3 input and receive signal on output 4 from the last switching element $B_4$ when all elements $C_1$, $C_2$, and $C_3$ have been interrogated. Current pulses from output sensors 9, as shown in diagram 13 comprising time intervals $\Delta t_1$, $\Delta t_2$, and $\Delta t_3$, are processed by electronics 11 and are presented in a suitable form in 12, i.e. an optional display or diagram listing.

FIG. 7 shows a delay line I that scans a number of states of a medium, e.g. a mass of soil, in order to record differences of e.g. moisture, temperature, pH-values or combinations of these parameters, suitable sensor elements $6_1$–$6_n$ being located in said mass of soil and connected to the inputs of line I.

FIG. 8 illustrates the transition phase when input 3 of the switching element changes state, i.e. both switches are conductive and the current I through the switches reaches its maximum value. This occurs in area III as shown in the Figure.

In FIG. 9 the relationship between current pulses B' on the common conductors and the voltage levels $V_{in}$ 1–4 on the control inputs of the switching element is shown by way of example. Here, an embodiment is considered comprising four switching elements with associated delay circuits. The switching elements in the shown embodiment are non-inverting.

FIG. 10 illustrates various arrangements of the delay circuit. 2.1 illustrates how capacitor C as a sensor element has been connected between input and output of the switching element.

In FIG. 11 a delay line is shown having feedback and in the shown example being capable of reactivating itself upon a change of state on the output of the last control signal $7_4$, and, the available control signals $7_1$–$7_4$ occurring in a time sequence determined by e.g. the sensor via inputs $6_1$–$6_4$. Gate G in the shown embodiment comprises an inverting "AND-gate" that controls the feedback function by the aid of the signal line a form signal processor p, which also processes the current pulses from line output 5. A typical pulse diagram is also shown.

Figure 12A:
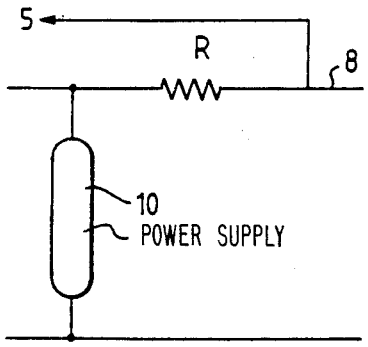
Figure 12B:
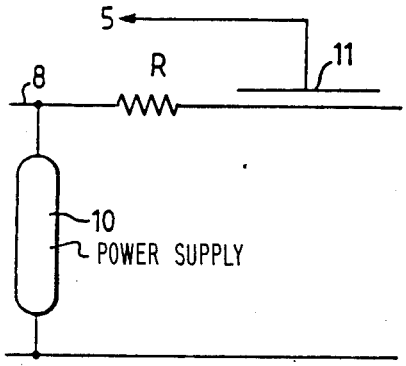
Figure 12C:
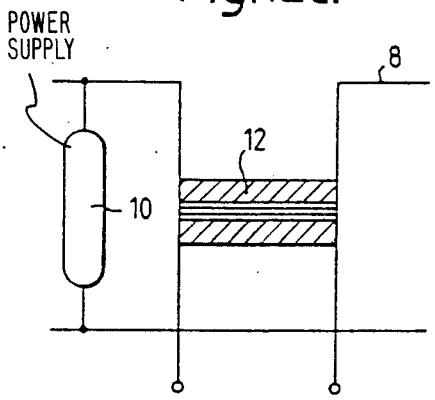
Figure 12D:
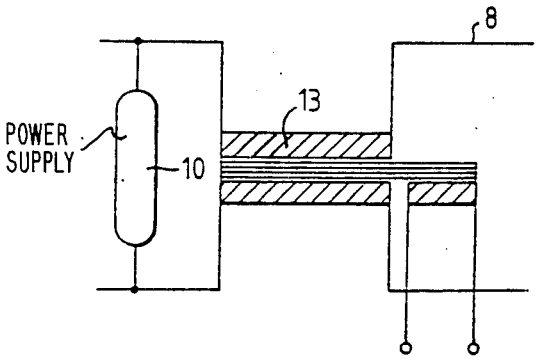

In FIGS. 12*a–d* various sensing systems for the dynamic pulse train on the common conductor 8 in series with current supply 10 are shown. FIG. 12*a* illustrates the recording of current pulses as voltage drops via resistance R on output 5. FIG. 12*b* shows the recording of current pulses in the form of capacitive connection to circuit 8. FIGS. 12*c* and 12*d* show various transformer connections 12 and 13 for recording the current pulses in the circuit.

The invention described above permits an almost infinite number of sensors to be connected to a common line without loading it. This mans that in a state of rest all sensors and possible delay lines are disconnected from the line. When the line is activated, this is controlled from the end point forming the starting point. Consequently the line is only loaded for a short time, and only by one element at a time, whereas the sensor or portions of it determine the time delay $\Delta t$ of the next load, provided that the control signal from the input is not changed. In this manner the line impedance is kept approximately constant, i.e. it is only affectable in a small degree or almost not affected by the number of sensors or elements involved in the line.

In contrast to known systems utilizing multivibrator the present invention represents a system which due to it special construction and mode of operation is almost unaffected by temperature and voltage and is inaffectable by transient or parasitic pulses. This is largely due to the fact that the main circuit 8,8' is only loaded by active components i.e. the passive components only determine the delay interval Δt. The number of components is, thus, reduced to a minimal.

Another characteristic of the present invention is the fact that the line with sensors or pure delay networks or combination of such components may be used in a multi-dimensional structure of selfgenerating combinatorial circuits The line may be considered as a coupling means with several different inputs to control said line as well as outputs to control other lines or systems as described below.

The arrangement, thus, in principle comprises a current source across which one or a plurality of switching elements are connected in parallel. The switching elements again consist of two switches connected in series, and in a state of rest one is always open and the other closed.

This means that the circuit is always open. A delay circuit connects the separate switching elements, the output of the first element being connected to the input of the subsequent element, etc. When said first switching element is activated one of the switches, i.e. the open switch, will close somewhat before the closed switch is opened (make before break).

A current pulse of short duration is recorded on the main circuit when it is loaded by a "short circuit", the current being limited by the inherent resistance of the switch in series with the main current source.

After a delay determined by the delay circuit the same will occur with the next element, etc.

The delay circuit can consist of any delay circuit that consists solely or partly of a sensor or the like. It may be suitable to connect said switching element with said current source via a common line. In principle this constitutes a delay line.

The sequence of signal propagation to change switch states in the separate switching elements is determined by the delay circuits between switching elements.

The rate of signal propagation varies with the separate delay circuits. This means that the total delay is at any time determined by the sum of every single delay element in the line.

The extent of signal propagation, i.e. the number of elements to change their switch state, is determined by the control signal on the first switching element. If said switching element returns to its original state before all elements have changed their state, those elements that have changed state will return to their original state. In this manner the extent and direction of the delay line is controlled.

From the above description it will appear how it is possible to extract measurement data from a comparatively large number of measuring points in time division multiplex. By recording the current pulses on different points on the line said pulses may be utilized as partial information in the form of a dynamic output for the line extent in time.

As a unit the line may be considered a coupling element with inputs and outputs. The inputs are essentially as stated above. The control signal initiates and determines the extent of signal propagation. Inputs directly influencing the delay between the separate switching elements will be contributory as to the rate of propagation. As well as being sensing, capactive, inductive, or resistive elements, or combinations thereof, said input signals may also be voltage or current levels.

The output signals occur in two main groups. Outputs of a more dynamic kind are tapped at different locations from the line or in one or several of the switching element branches from the main line. Outputs of a more static kind are represented by the centers of the switching elements, which mainly change between zero and the voltage on the main line. This also applies to the last element of the line, i.e. when the entire line has been swept and all switching elements have changed state.

With said inputs and outputs the signal information on the line may be described as two-way, as it is possible to gather as well as pass on information.

The described invention in the first place offers great possibilities for scanning large number of measuring points converted to time division multiplex as well as for combinations of inputs and outputs from several lines in such a manner that they result in a multi dimensional structure of self generating combinatory circuits.

Possibilities of combining will also exist within one and the same line, where some of the sensors in a specific geometric grouping will influence the scanning pattern or another group; also the scanning sequence of sensors is such that the dynamic pulse pattern occurs in a characteristic time sequence, as shown in FIGS. 4, 6 and 7.

Among other possible applications the following are mentioned: A continuous supervision of structures with suitable sensor elements located near construction details to be supervised from a central position. This may concern dams, where it is of interest to record moisture gradients and settlement.

Another application is security supervision to point out alarm positions. The utilized sensor system may record changes of pressure, temperature, acoustics, light, or simply a closed or open contact.

Depending on the field of application signal processing will always require signal processing electronics which process the signal information to the desired kind of display, detects alarm criteria and controls operations. To carry out said tasks some kind of microprocessor will form the most universal solution.

The possibilities of application offered by said switching elements are best comparable with the sensory and motory signal paths of a living nerve system and its countless logical connections.

I claim:

1. An arrangement for the distribution and/or extraction of signals from connection points comprising:

(a) a common transmission medium comprising two wires, said two wires comprising power supply lines to said connection points, (b) a plurality of connection points, each comprising a switching element having first and second separate switches in series, said series connection of switches coupled across said two wires, each switching element having a control input between said power supply lines for controlling said first and second switches in a make-before-break manner such that in a state when no control input signal is provided at the control input, either the first switch is closed and the other switch is open or the first switch is open and the other switch is closed, and when a control input signal is provided, the open one of said switches closes before the other of said switches opens, thereby generating a make-before-break contact duration, each switching element further having an output at a point of series connection of said first and second switches, p1 (c) a variable delay circuit having a control input for coupling to a delay changing means responsive to a parameter representing a signal to be distributed or extracted, adapted to vary the delay of said circuit in accordance with said parameter, one variable delay circuit coupling each switching element output to the input of the next successive switching element, thus forming a cascade coupling whereby a pulse supplied to the first switching element will result in series of current pulses, each pulse corresponding to length to said make-before-break contact duration and comprising a short-circuit pulse on said common transmission medium with the delay between pulses representing the values of the parameters controlling said variable delay circuits, and (d) an output sensor coupled to said common transmission medium for gathering signals transmitted by said connection points.

2. An arrangement as stated in claim 1, wherein the make-before-break contact duration is short so that the common transmission medium is closed only for a short time while switching of said switches takes place, independent of the number of switching elements in the overall arrangement, since only one switching element operates at a time.

3. An arrangement as stated in claim 1, and further including means for supplying a pulse to the control input for activating the first switching element whereby the sequence and number of switch changes is enforced through successive activation of each switching element from the previous switching element via the intermediate variable delay circuit, the first switching element being activated from said control input.

4. An arrangement as stated in claim 1, wherein said common transmission medium and the switching elements form a two-way signal distribution line.

5. An arrangement as stated in claim 1, wherein said switching elements comprise semiconductors.

6. An arrangement as state in claim 1, wherein said switching elements comprise mechanical switches.

7. An arrangement as stated in claim 1, wherein a number of switching elements together with intermediate delay circuits are coupled to form a delay line, whereby said delay line may be considered as a coupling element.

8. An arrangement as stated in claim 7, wherein said coupling element has characteristic inputs and outputs of static as well as dynamic nature and further including other similar coupling elements coupled therewith to form a multi-dimensional combinatorial circuit.

9. An arrangement as stated in claim 8, wherein signal extraction and distribution is enforced both as to extend in time and direction by the input of the first coupling element.

10. An arrangement as stated in claim 1, wherein a plurality of output sensors are provided and said output sensors comprise transformers, and means to record the time intervals between pulses coupled to said output sensors.

11. An arrangement as stated in claim 1, wherein a plurality of output sensors are provided and comprise capacitive sensor means for sensing current pulses, and means to record the time intervals between pulses coupled to said output sensors.

12. An arrangement as stated in claim 1, wherein a plurality of output sensors are provided and comprise resistors for sensing voltage drop pulses of short duration, and means to record the time intervals between pulses coupled to said output sensors.

13. An arrangement as stated in claim 1, wherein said delay changing means comprise an electrical delay network comprising electrical elements whose electrical parameters are variable under the influence of a physical parameter.

14. An arrangement as stated in claim 1, wherein said delay changing means further comprise electrical elements whose electrical parameter values can be chosen at will or be set according to output values from other circuits.

* * * * *